US011591792B2

(12) United States Patent
Campanelli

(10) Patent No.: US 11,591,792 B2
(45) Date of Patent: Feb. 28, 2023

(54) SYSTEM AND METHOD FOR SEGMENTING SPACES

(71) Applicant: Bruce Allen Campanelli, Cumming, GA (US)

(72) Inventor: Bruce Allen Campanelli, Cumming, GA (US)

( * ) Notice: Subject to any disclaimer, the term of this patent is extended or adjusted under 35 U.S.C. 154(b) by 0 days.

(21) Appl. No.: 17/304,696

(22) Filed: Jun. 24, 2021

(65) Prior Publication Data

US 2022/0025650 A1 Jan. 27, 2022

Related U.S. Application Data

(60) Provisional application No. 62/705,908, filed on Jul. 22, 2020.

(51) Int. Cl.
*E04B 2/78* (2006.01)
*E04B 2/74* (2006.01)

(52) U.S. Cl.
CPC .... *E04B 2/7845* (2013.01); *E04B 2002/7462* (2013.01)

(58) Field of Classification Search
CPC ..... E04B 2/7437; E04B 2/761; E04B 2/7845; E04B 2/828; E04B 2002/742; E04B 2002/7446; E04B 2002/7462; E04B 2002/7466; E04B 2002/7479
See application file for complete search history.

(56) References Cited

U.S. PATENT DOCUMENTS 3,362,459 A * 1/1968 Frank ..... A47H 21/00 160/135
3,575,407 A * 4/1971 Carson ..... A61G 13/10 128/849
4,143,698 A * 3/1979 Smolka ..... E04B 2/821 160/135
4,250,676 A * 2/1981 Presby ..... G09F 15/0068 52/239
4,493,172 A * 1/1985 Jones ..... E04B 2/7845 52/220.1
4,885,000 A * 12/1989 Hogan ..... A61B 16/00 312/1

(Continued)

FOREIGN PATENT DOCUMENTS

FR 3005079 A1 * 10/2014 ..... E04H 17/168
GB 2439165 A * 12/2007 ..... E04B 2/744

*Primary Examiner* — James M Ference
(74) *Attorney, Agent, or Firm* — Dunlap Bennett & Ludwig, PLLC; Anna L. Kinney

(57) ABSTRACT

The present invention provides a system and method for segmenting spaces. The system may provide an aluminum extrusion system for supporting rigid and flexible panels. The aluminum extrusion system may comprise a custom designed aluminum extrusion that may mount flexible or rigid substrates with interlocking bases and connectors. The system is constructed and arranged to be capable of temporary and permanent installation, and is structurally sound, and safe. The system is design to be capable of effectively blending with the existing décor. The aluminum extrusion system provides a method for segmenting space to maximize the functional space which may be utilized, in a way that is attractive, functional, temporary or permanent, and portable.

10 Claims, 6 Drawing Sheets

(56) References Cited

U.S. PATENT DOCUMENTS 5,004,198 A * 4/1991 Jager ..... A47F 5/106 248/224.8
6,546,675 B1 * 4/2003 Adderton ..... E04F 11/1851 52/282.1
6,599,055 B2 * 7/2003 Auer ..... E04B 2/7427 403/381
6,766,623 B1 * 7/2004 Kalnay ..... E04B 1/3441 135/147
7,063,096 B2 * 6/2006 Stoeckler ..... E04H 15/644 135/114
7,323,025 B2 * 1/2008 Weidner ..... A61G 10/005 55/385.2
8,445,093 B2 * 5/2013 Lemer ..... A61B 6/107 128/849
9,504,345 B2 * 11/2016 Stibich ..... A47H 13/00
9,719,292 B1 * 8/2017 James ..... E06B 9/58
9,861,222 B2 * 1/2018 Bauer ..... A47H 13/04
10,493,176 B2 * 12/2019 McCormick ..... A61L 2/10
2002/0023391 A1 * 2/2002 Nymark ..... E04B 2/7453 211/94.01
2003/0039507 A1 * 2/2003 Liu ..... F16B 7/00 403/217
2004/0074613 A1 * 4/2004 Junger ..... A47H 13/04 160/330
2004/0134529 A1 * 7/2004 Stoeckler ..... E04H 15/644 135/114
2004/0237198 A1 * 12/2004 Yang ..... A61M 16/08 5/512
2007/0283630 A1 * 12/2007 Kasdorf ..... E04B 2/744 52/36.1
2008/0283202 A1 * 11/2008 Serio, III ..... A47H 1/06 29/700
2009/0025321 A1 * 1/2009 Cherney ..... E04B 2/827 52/238.1
2015/0020473 A1 * 1/2015 Fox ..... E04D 5/146 52/712
2015/0327706 A1 * 11/2015 Harter ..... A47H 23/02 160/126
2016/0115704 A1 * 4/2016 Burke ..... A61G 7/05 135/126
2017/0159289 A1 * 6/2017 Strong ..... E04B 2/7437
2018/0128011 A1 * 5/2018 Preston ..... E04B 1/34321
2018/0177321 A1 * 6/2018 Heidsiek ..... A47H 23/08
2018/0274231 A1 * 9/2018 Epstein ..... E04B 2/7442
2018/0298687 A1 * 10/2018 Hall ..... E04B 2/7453
2020/0386047 A1 * 12/2020 James ..... E06B 9/0692
2022/0025650 A1 * 1/2022 Campanelli ..... E04B 2/7437

* cited by examiner

SYSTEM AND METHOD FOR SEGMENTING SPACES

CROSS-REFERENCE TO RELATED APPLICATION

This application claims the benefit of priority of U.S. Provisional Application No. 62/705,908, filed Jul. 22, 2020, the contents of which are herein incorporated by reference.

BACKGROUND OF THE INVENTION

The present invention relates to building materials, and more particularly to a system and method for segmenting spaces. and supporting various substrates in a modular, attractive and easy to use system.

Current options regarding segmented spaces are limited.

Previous systems do not provide complete systems that may be installed in permanent, temporary or movable manner.

Previous systems do not provide sufficient flexibility or ease of installation. Previous systems do not provide a complete, structurally sound system with securely mountable components. Previous systems are further unattractive and are functional only for small areas. Previous systems are not adjustable in size, and do not blend with existing décor.

Existing systems are usually designed for only one type of substrate, and require precise sizing of substrates such as fabric to get a tight smooth fit. Also, existing systems are not easy to adapt to various installation situations, and are designed for a more industrial look and have many different parts causing confusion in assembly.

Existing systems do not provide sufficiently attractive or sufficiently safe options to segment both large and small private or public spaces. Previous systems further disrupt existing décor.

As can be seen a solution is needed to these problems.

SUMMARY OF THE INVENTION

Advantageously, in one aspect, the present invention provides a system for segmenting spaces comprising an apparatus for mounting flexible or rigid substrates. The substrates may be transparent. The substrates may be decorative. The system is capable of use for segmenting private or public spaces. The system may be used in any suitable location. The system of the present invention provides an attractive and safe option for segmenting spaces which does not disrupt existing décor.

In one aspect, the present invention provides a complete system for segmenting spaces which may be installed in permanent, temporary or movable manner. The system is an aluminum extrusion system for supporting rigid and flexible panels.

In a further aspect the system of the present invention provides tremendous flexibility, ease of installation, and a complete system which is structurally sound and attractive. The system components are versatile and capable of being securely mounted to floors, walls ceilings or counters and blend with existing décor in any suitable space, including private and public spaces. The system may be used to segment public spaces or support substrates in and attractive and safe manner, providing functionality for areas of all sizes of spaces.

In a still further aspect, the present invention allows clear substrates to be attached or positioned securely and in a way that does not disturb the existing décor. The present invention provides a complete system that may be installed in a permanent or movable manner.

In one aspect, the system of the present invention uses a custom designed aluminum extrusion that may mount flexible or rigid substrates with interlocking bases and connectors. The system of the present invention may be used to separate large areas, to provide segmenting of maximum space to be utilized in a way that looks attractive.

In one aspect, the system for segmenting spaces comprises a plurality of aluminum extrusions. The plurality of aluminum extrusions may further comprise a first vertical aluminum extrusion, a second aluminum extrusion, at least one horizontal aluminum extrusion; and at least one substrate secured between the first vertical extrusion and the second vertical extrusion. The at least one substrate may be selected from rigid substrates and flexible substrates. The substrate may further comprise lateral keders and lateral Torque Loc™ elements. In some embodiments, the substrate may be a flexible transparent panel.

In a further aspect, the system may further comprise a plurality of metal bases, said plurality further comprising a first metal base constructed and arranged for supporting the first vertical aluminum extrusion, and a second metal base constructed and arranged for supporting the second vertical aluminum extrusion. Each vertical aluminum extrusion may further comprise an internal channel and a spring button constructed and arranged to lock into the base. Each metal base may further comprise a base locking hole and a base keyway. The system may further comprise a plurality of L-connectors constructed and arranged to join the first vertical aluminum extrusion and the second vertical aluminum extrusion to the at least one horizontal aluminum extrusion extending therebetween.

In some embodiments, the system may further comprise at least one 3-4 way spacer located between the first vertical aluminum extrusion and a first end of the at least one horizontal aluminum extrusion, and at least one 1-2 way spacer located between the second vertical aluminum extrusion and a second end of the at least one horizontal aluminum extrusion.

In some embodiments, the system may further comprise a wall connector assembly.

These and other features, aspects and advantages of the present invention will become better understood with reference to the following drawings, description and claims.

BRIEF DESCRIPTION OF THE DRAWINGS

The preferred embodiment of the claimed subject matter will hereinafter be described in conjunction with the appended drawings provided to illustrate and not to limit the scope of the claimed subject matter, where like designations denote like elements, and in which:

It is to be understood that like reference numerals refer to like parts throughout the several views of the drawings.

DETAILED DESCRIPTION OF THE INVENTION

Figure 1:
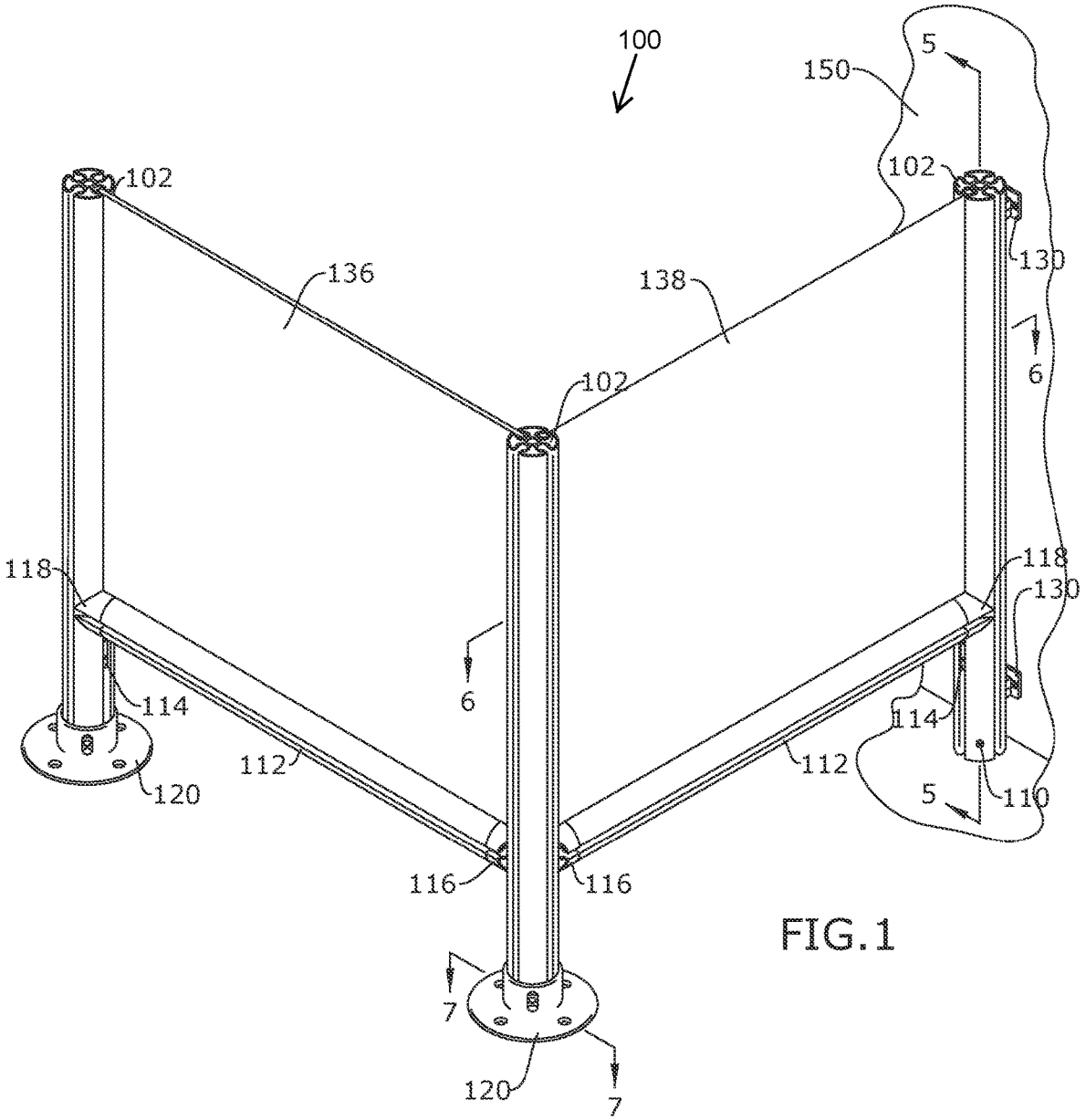
FIG. 1 is a perspective view of the invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

As used herein, "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, as there is no intention to be bound by any express or implied theory presented in the preceding technical field, background, brief summary or the following detailed description, it is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Broadly, one embodiment of the present invention provides a system and method for mounting flexible or rigid substrates.

In an exemplary embodiment the present invention provides an aluminum extrusion system for supporting rigid and flexible panels. The present invention may comprise a custom designed aluminum extrusion system capable of mounting flexible or rigid substrates with interlocking bases and connectors, by which the maximum space may be segmented and utilized in a way that is not only durable and safe, but also looks attractive.

In an exemplary embodiment the system may include a plurality of aluminum extruded vertical poles, and a metal base for supporting each vertical pole. Each pole has internal channels and a spring button constructed and arranged to lock into the base. Each metal base has locking holes and a position keyway. A metal insert associated with locking screws forms a 90 degree structural attachment between the aluminum vertical poles and an aluminum extruded horizontal pole extending therebetween. Panels including lateral PVC keders are constructed and arranged to be securely mounted between the aluminum vertical poles. The internal channels of each vertical pole include a circular portion and a straight slot. The keders are constructed and arranged to fit into a circular portion of the internal channel without being able to be removed through the straight slot. The PVC keder is capable of fitting through the straight slot and is held in place by torsion where the circular portion pivots to lock in place. The horizontal extruded pole with locking screws is constructed and arranged to extend between and connect the vertical extruded poles. The system may further include a metal insert with a circular extension, a metal plate with interlocking pin and a decorative plastic cap.

Utilizing a unique straight slot and circular internal channel, each vertical pole may accommodate both rigid and flexible substrates of almost any type up to 6 mm thick. Thanks to the tubular nature of the innermost portion of the poles, the 90 degree inserts may slidably engage the pole for easy adjustments. The square portion of the insert prevents rotation, automatically keeping the poles in alignment, and may further be set in place by a small number of screws. All structural pieces fit within the internal channels, lending to a finished looking product that is both structurally sound and decoratively pleasing. The pole inserts into the very strong cast metal base and is held in place with the use of spring buttons that interlock automatically when inserted, creating a safe and secure mounting system. The various inserts and spacers allows a wide degree of freedom for design, mounting and securing into place. The lateral keder of the panels permits insertion through the face of the channel, but attaches and locks the substrate panel in place when put into torsion by sliding the opposing pole to create tension in the substrate.

The system comprises aluminum extruded poles with internal channels that are both round and square. The channel shapes allow installation of both rigid panels up to 6 mm thickness, and flexible panels having lateral vinyl keders attached thereto by any suitable attachment means. Each vinyl keder may be welded or sewn onto the panels. The vinyl keders enable the panels to be locked into place internally. The poles are held together using a cast metal insert that is both round and square shaped and is secured with set screws to apply force to the internal channel when tightened. When the set screws are loosened, the poles may slide into the proper position freely. The square portion of the channels prevent the pole from moving side to side, maintaining the proper angles for assembly. Using shape cut spacers made out of the same extrusion, a finished look is achieved that is seamless: the spacers also add rigidity to the structure. Since the set screws and inserts are internal to the pole, no fasteners are visible, which improves the look of the finished designs. Because the vertical and horizontal aluminum poles may be made to any length, many different applications are suitable for the system.

Necessary pieces of the system are the extruded poles, the 90 degree inserts with set screws, and the spacers. Optionally, the metal bases may be provided, into which the pole may be inserted to mount vertically or horizontally from one end. Each base has holes for mechanically mounting to various surfaces or may be attached via adhesive foam disks for removability. Each vertical pole has spring loaded push buttons that interlock with the metal base and is set in place with a keyway matched to the slots in the aluminum pole. In some embodiments, the system may include internal mounting connectors that allow the poles to be hung vertically from the ceiling, and an interlocking plate that allows the poles to be mounted to a flat surface directly, or to mount a flat surface to the face of the poles, allowing for table tops or shelving to be added. There is also an optional plastic cap that locks into the center hole on the end and gives a finished appearance.

In some embodiments, the rigid aluminum poles may be assembled using the internal cast metal inserts into an almost unlimited configuration of right angles using only one small hex wrench. For a freestanding divider, the pole may be inserted into the metal base with keyway. Most applications will use at least two of these vertical pole and base assemblies. The same type of pole of the proper length would then be installed horizontally between the vertical uprights using the special 90 degree internal connector and a shape cut spacer on either end that connects to the vertical pole. The connector slides freely into the internal channels on both the vertical and horizontal poles until the four set screws are tightened on each connector. Once the initial framework is secure, a panel may be inserted into the internal channel and then another horizontal pole with connectors and spacers is assembled to the top between the vertical poles. The panel will be held in place in the internal channels. This structure may then be used as is or added on to create very long sections or even enclosures and multi sided dividers.

In some embodiments, the horizontal and vertical poles may have identical structure, and be capable of use as either the horizontal or the vertical pole elements.

The system of the present invention may be used in any application that requires a substrate to be held in rigid suspension. Nonlimiting examples include point of purchase, trade show exhibits, office cubicles and room dividers, shipping containers, shelving, tables, storage, seating dividers, computer monitor holder, directional signage, room décor or the like. Because of its strength and stiffness and the ease and flexibility of assembly, there are also numerous possible structural applications.

Because of the unique shape of the internal channel and the ability of the poles to slide into position, by using a specific vinyl keder fixed to a fabric substrate and inserted into the smaller opening of the side or top channel, a fabric display that uses torsion to hold the fabric in place and adjust the tension makes it a unique design that distinguishes over and differs from previous systems with a sewn flat keder used by pushing it into a defined shape that cannot be adjusted for tightness.

The present invention provides an unprecedented structure for mounting flexible or rigid substrates. The system includes a sliding interlocking insert that only requires one small hex wrench for all assembly and adjustment. The internal channels of the extrusion allow any substrate to be used up to 6 mm (¼") thick including fabric.

In an exemplary embodiment, the system for segmenting spaces may comprise one or more of the following elements or components and combinations thereof:

a plurality of aluminum extrusions having a spring button located on each aluminum extrusion, the aluminum extrusions comprising a first vertical aluminum extrusion, a second vertical aluminum extrusion, and at least one horizontal aluminum extrusion;
a plurality of L-connectors;
at least one 3-4 way spacer;
at least one 1-2 way spacer;
at least one base, the base comprising a base keyway, a base locking hole, and a wall pin insert;
a connecting receptacle;
a wall connector;
a wall connector post;
a plurality of set screws;
a solid or rigid substrate panel having lateral keders;
a flexible substrate panel having lateral keders; and
a Torque Loc™ element.

The system may be constructed and arranged to be a free-standing system or for securement to a wall.

Referring to the Figures, in an exemplary embodiment, the system, shown generally at 100, may comprise one or more of the following elements or components and combinations thereof:

a plurality of vertical aluminum extrusions 102;
a spring button 110 located on each vertical aluminum extrusion;
at least one horizontal aluminum extrusion 112;
a plurality of L-connectors 114;
at least one 3-4 way spacer 116;
at least one 1-2 way spacer 118;
at least one base 120, comprising a base keyway 122, a base locking hole 124;
a wall pin insert 126;
a connecting receptacle 128;
a wall connector 130;
a wall connector post 132;
a plurality of set screws 134;
a solid or rigid substrate panel 136;
a flexible substrate panel 138;
a keder 140; and
a Torque Loc™ element 144.

The system 100 may be constructed and arranged for installation on a wall 150.

In an exemplary embodiment, dimensions of the various exemplary components of the aluminum extrusion system are as provided in the Figures.

The system and its components may be made of any suitable material, and may be fabricated by any suitable process.

In an exemplary embodiment the system 100 may comprise a plurality of vertical extrusions 102. Each vertical extrusion may be an aluminum vertical extrusion 102. Each aluminum vertical extrusion may be an aluminum extruded pole with internal channels. The system may further comprise at least one horizontal aluminum extrusion 112. The system may include connector elements, a plurality of L-connectors 114, at least one 3-4 way spacer 116 and at least one 1-2 way spacer 118. In use, as shown at FIGS. 1-7, a first vertical extrusion, a second vertical extrusion and a horizontal extrusion may be releasably connected by the L-connectors, at least one 3-4 way spacer and at least one 1-2 way spacer.

Figure 2:
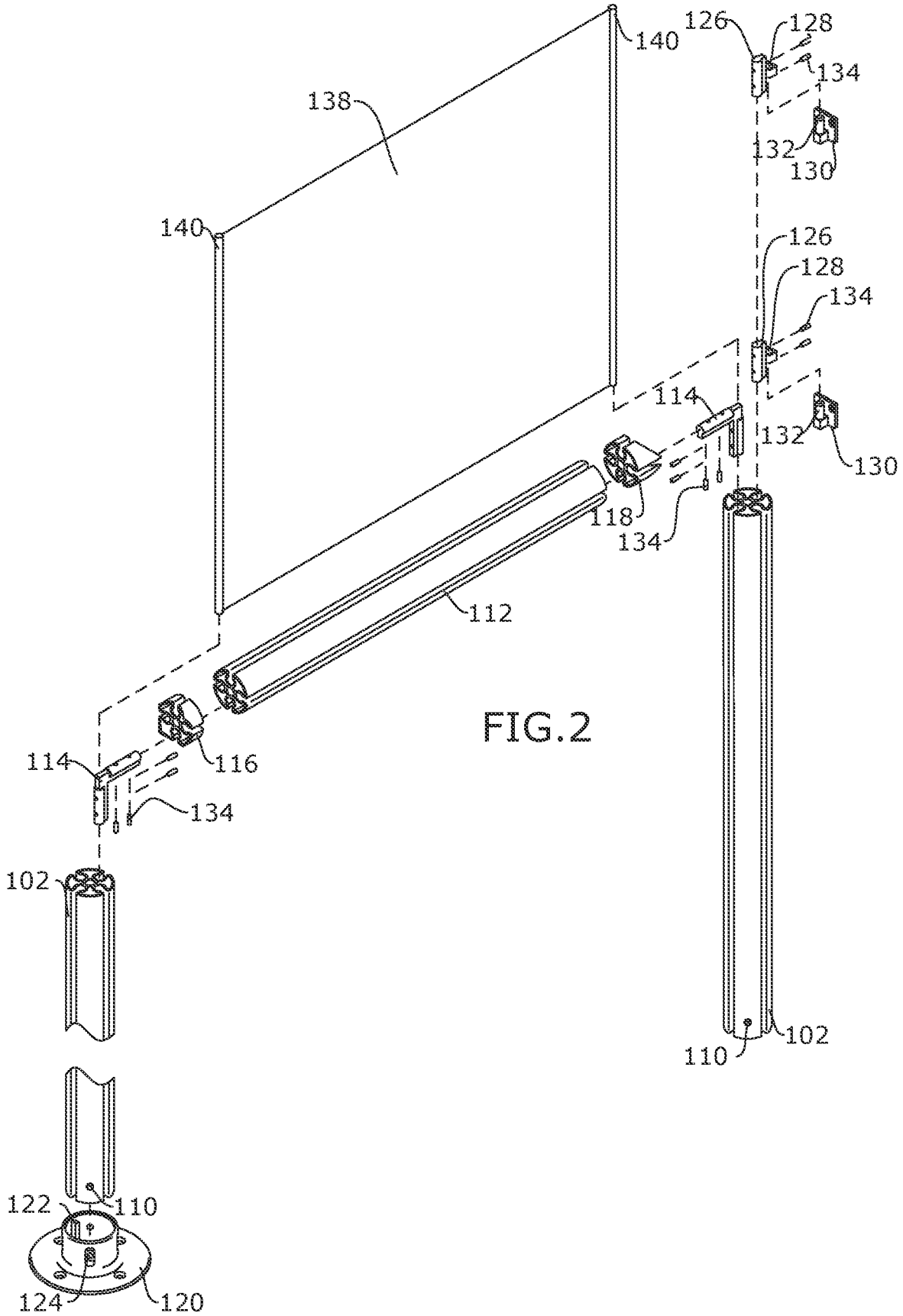
FIG. 2 is an exploded view of the invention.

As seen at FIG. 2, the at least one base 120 comprises a base keyway 122, and a base locking hole 124, the base 120 being constructed and arranged to receive a vertical extrusion. Each aluminum vertical extrusion 102 may further comprise a spring button 110 to lock into the base 120.

FIG. 1 provides a perspective view of the invention. FIG. 2 provides an exploded view of the invention and its components. An aluminum extrusion may be attached to a wall by at least one wall mount assembly. Each wall mount assembly comprises a wall pin insert 126, a connecting receptacle, a wall connector 130 a post 132 and a plurality of set screws. The wall pin insert 126, and the connecting receptacle 128 are removably secured to the vertical extrusion 102. The wall connector 130 includes a post 132 shaped to mate with the connecting receptacle 128.

Figure 9:
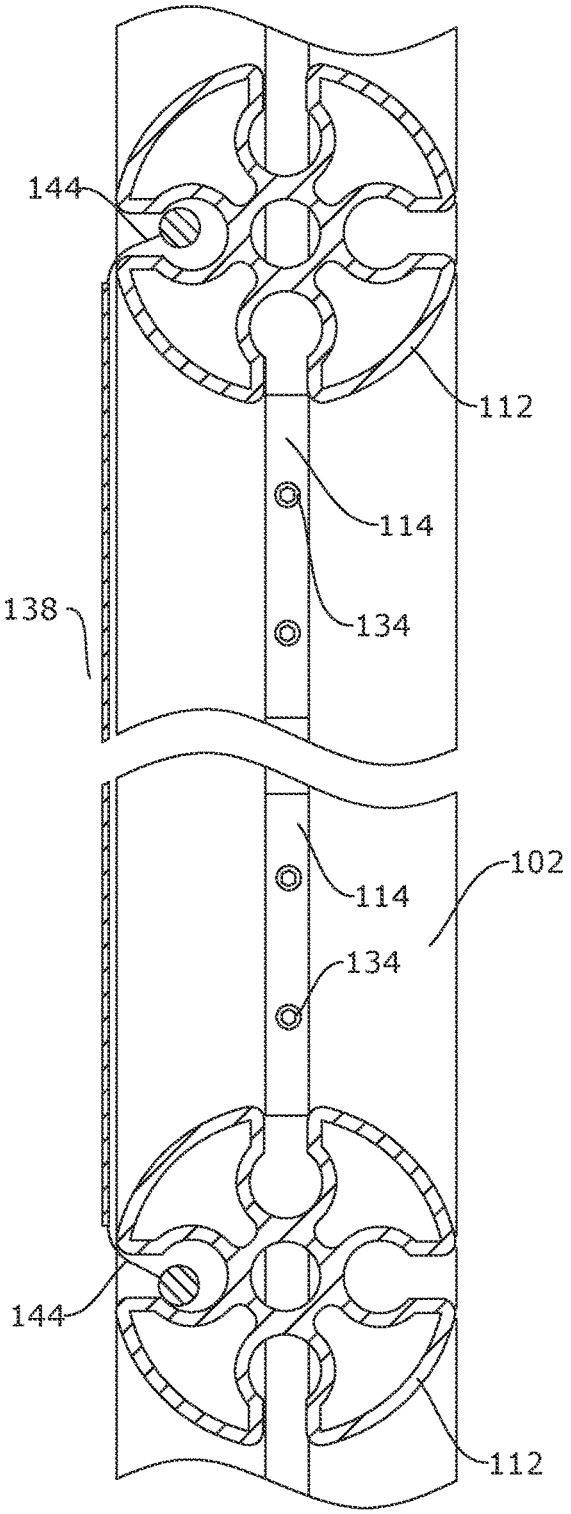
FIG. 9 is a section view of the invention, taken along line 9-9 in FIG. 8.

A solid or rigid substrate panel 136 or a flexible substrate panel 138 may each include a keder 140 at a lateral edge thereof. The keder 140 is constructed and arranged to slidingly engage the vertical extrusion for mounting of the panel 136 or 138 therein. A Torque Loc™ element 144 is seen at FIG. 9.

Figure 3:
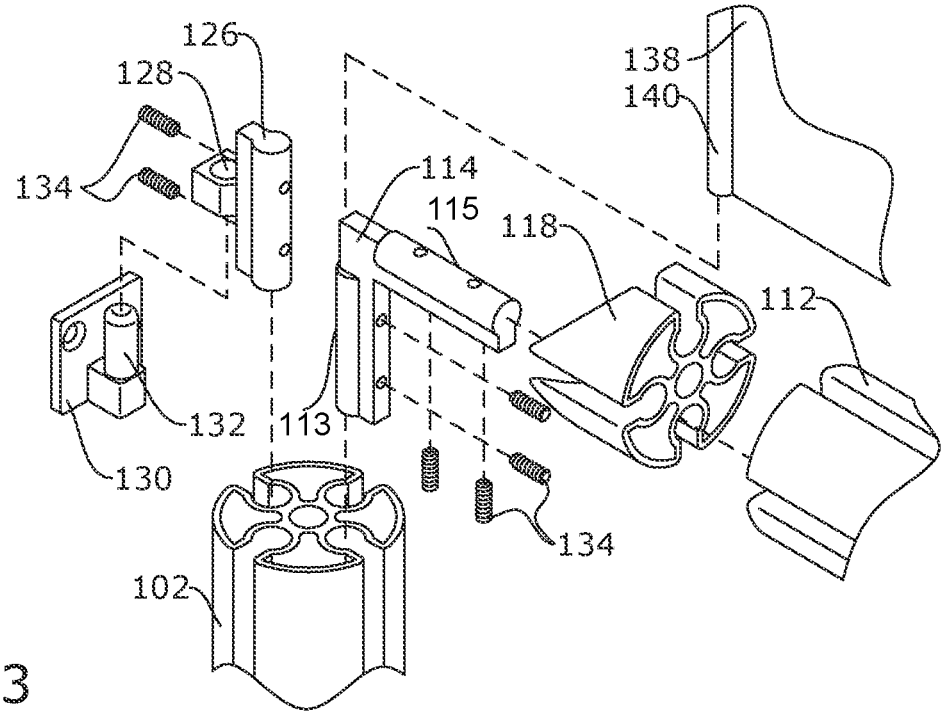
FIG. 3 is a detailed exploded view of the invention.
Figure 4:
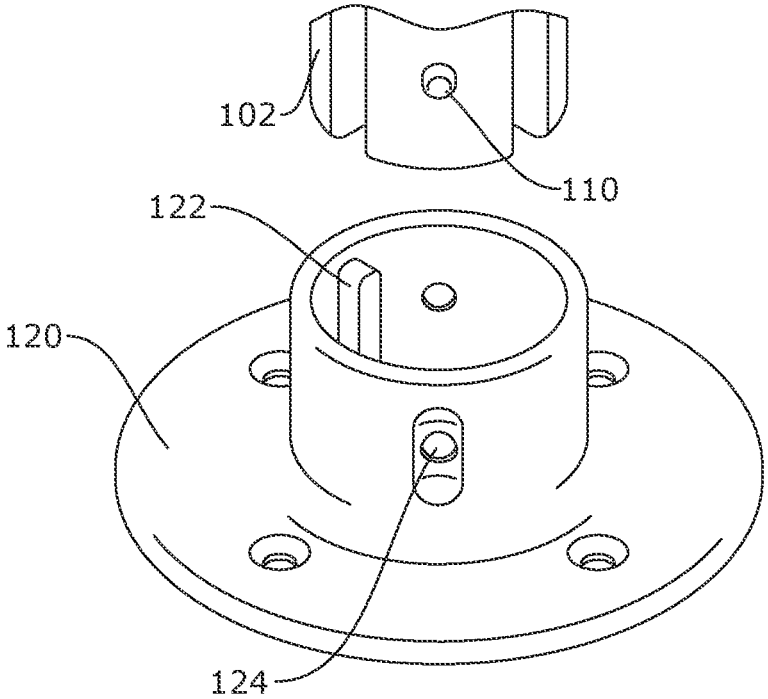
FIG. 4 is a detailed exploded view of the base.
Figure 5:
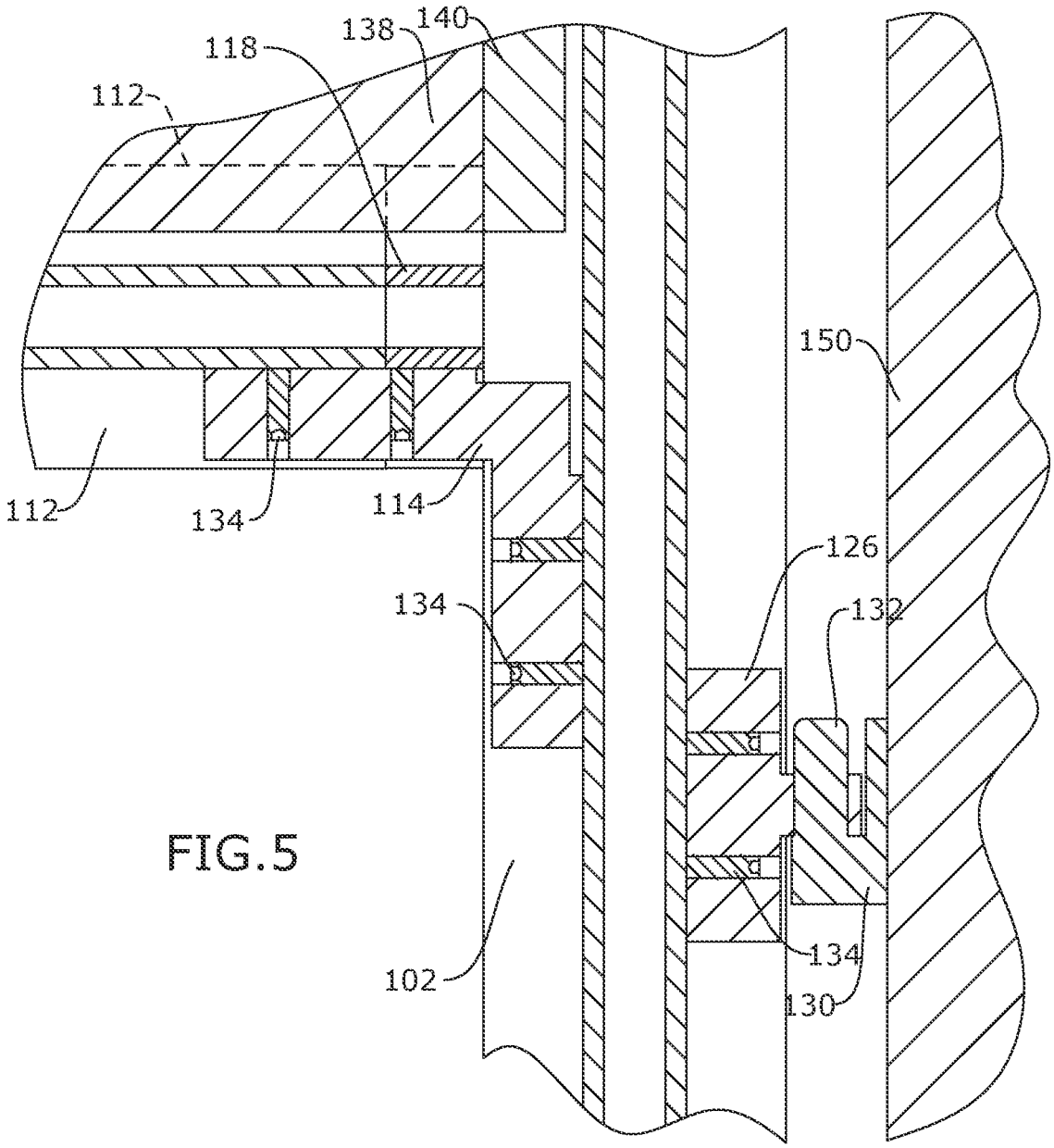
FIG. 5 is a section view of the invention, taken along line 5-5 in FIG. 1.
Figure 6:
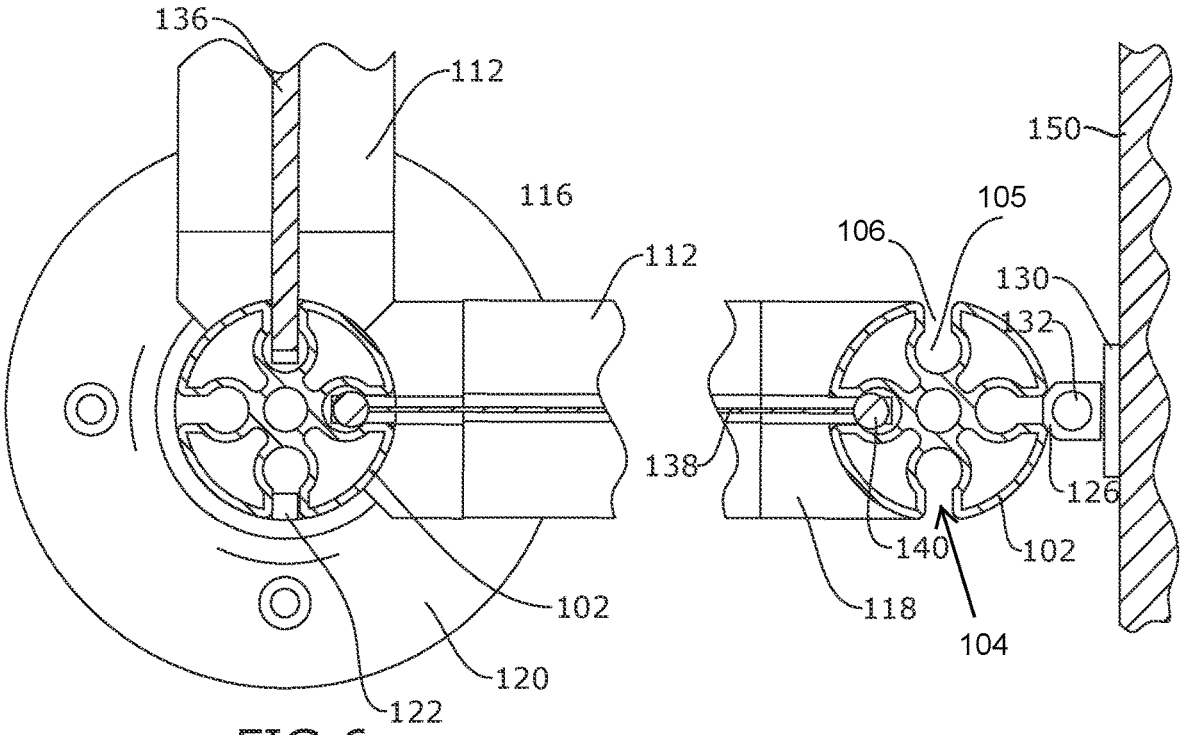
FIG. 6 is a section view of the invention, taken along line 6-6 in FIG. 1.
Figure 7:
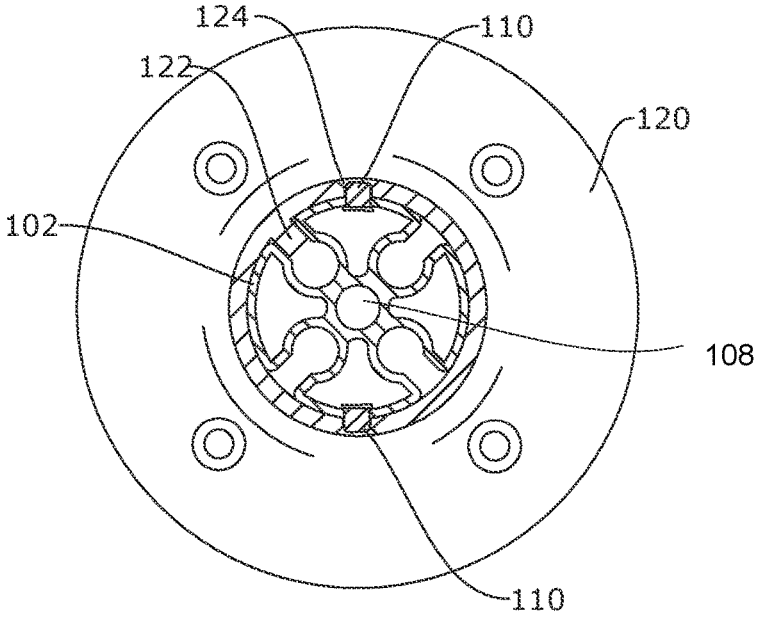
FIG. 7 is a section view of the invention, taken along line 7-7 in FIG. 1.
Figure 8:
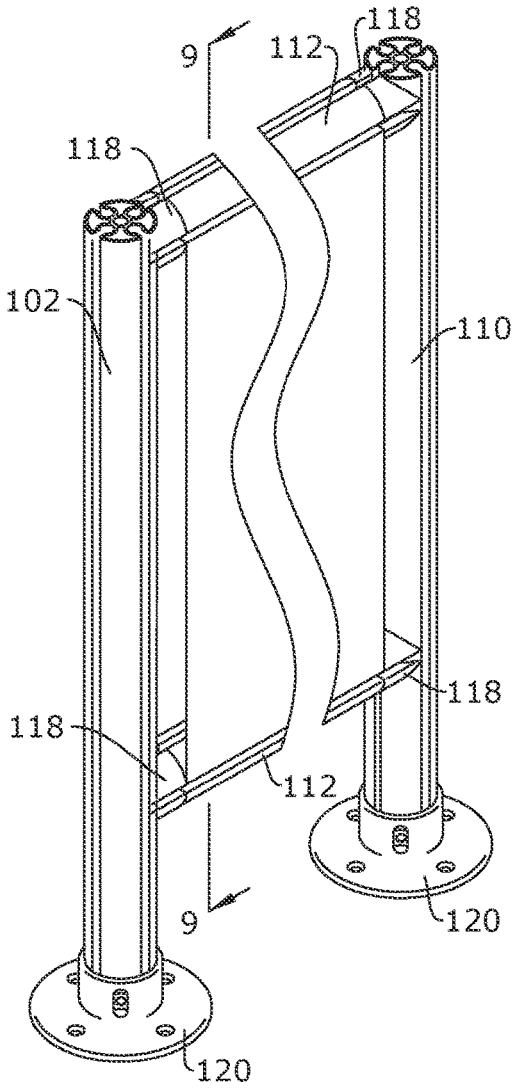
FIG. 8 is a perspective view of the invention showing an alternate flexible substrate holding method.

FIG. 2 provides an exploded view of the invention. FIG. 3 shows a detailed exploded view of the invention, including a closer view of an L-connector 114 having a first connector portion 113 and a second connector portion 115. FIG. 4 provides a detailed exploded view of the base. FIG. 5 provides a section view of the invention, taken along line 5-5 in FIG. 1. FIG. 6 provides a section view of the invention, taken along line 6-6 in FIG. 1. As FIG. 6 shows, the vertical extrusions 102 have an interior extrusion channel 104 around the circumference at 90° increments. The interior extrusion channels 104 have an inner portion 105 with a circular cross section, and an outer portion 106 with a square cross section. FIG. 7 provides a section view of the invention, taken along line 7-7 in FIG. 1, showing a vertical extrusion 102 fastened within a base 120. The vertical extrusion 102 has an internal channel 108 in addition to the interior extrusion channels 104. one of which accommodates a base keyway 122. The vertical extrusion 102 also has diametrically opposed spring buttons 110 which are accommodated by locking holes 124 in the base 120. FIG. 8: shows a perspective view of the invention showing an alternate flexible substrate holding method. FIG. 9 provides a section view of the invention, taken along line 9-9 in FIG. 8.

In an exemplary embodiment, the interrelationship between these components may be as follows. The aluminum vertical extrusion may include spring locking pins that may interlock into the base. The base may be attached to various surfaces using any suitable mechanical fasteners, nonlimiting examples of which may include screws, bolts, adhesives, or the like. The base may also be weighted to provide a freestanding base in applications where the system provides a movable partition. The horizontal extrusion may be attached to the vertical extrusions by connector elements, a plurality of L-connectors, at least one 3-4 way spacer and at least one 1-2 way spacer. A first vertical extrusion, a second vertical extrusion and a horizontal extrusion may be releasably connected by the L-connectors, at least one 3-4 way spacer and at least one 1-2 way spacer so the horizontal extrusion provides a cross beam support. Once the frame of extrusions has been assembled, a flexible panel with lateral keders and/or rigid panel with lateral keders may be installed into the internal channels in the vertical aluminum extrusion.

In some embodiments, the flexible panels may be manufactured by fixing a PVC keder at each of its opposing ends. The PVC keder is then capable of sliding into the channels in the vertical aluminum extrusion 110. The PVC keder may have a diameter of between about 6-8 mm. In some embodiments, the flexible panels may be fabricated by or sewing an 8 mm PVC keder into the opposing ends that then slide into the channels in the vertical aluminum extrusion 110.

In some embodiments, the rigid panels may be manufactured to size and an 8 mm keder may be welded to the opposing ends. Because the channels are smaller in the direction of the panel, the panel is held securely in place and cannot pull out of the channel unless lifted straight up.

In some embodiments, a decorative cap may be placed on the top of the vertical aluminum extrusion for both a decorative finish and to prevent any panel installed therein from lifting out of the vertical aluminum extrusion.

In an exemplary embodiment, the invention works in the following manner. The vertical aluminum extrusions may comprise four opposing internal channels set at 90 degrees to each other which accept properly prepared flexible or rigid panels. The panels are capable of being advanced into the internal channels from the end of the extrusion but are not capable of being pulled through the channel due to the smaller sized opening facing the panel. The panels may be locked into place using pins with set screws that may be slid into the channels above or below the panels. The vertical aluminum extrusion may include locking spring clips and/or pins that secure it to the base. The base may be attached to various surfaces using any fastening means, such as, for example without limitation, mechanical fasteners or adhesives. The base may also mechanically attach to a heavy weighted mounting plate (not shown) that may be placed on the floor to provide a movable support.

In an exemplary embodiment, the system of the present invention may be made as follows. The key to the process is the custom made aluminum extrusion having internal channels sized precisely to interlock with panels that are prepared with tubular ends or keders that may slide into the channels from the end of the extrusion but cannot pull through the sides of the extrusion.

In an exemplary embodiment, the rigid and flexible panels may comprise an 8 mm tube or keder welded to the opposing sides or ends. In some embodiments, the tube may comprise a PVC keder having a diameter of about 8 mm. Maximum rigid panel thickness inserted in the channel may be 6 mm. For freestanding applications, a section of the extrusion may be attached horizontally between two vertical sections attached to the base. This may be made possible using a semicircular cut piece that interlocks with both the vertical and horizontal sections by use of L shaped pins that are set in place using internal screws.

In an exemplary embodiment, at minimum, one aluminum extrusion mounted vertically into one base may hold one rigid panel in place. The rigid panel may be fixed on the opposing end using a channel attached to the surface on which the panel is set, preventing horizontal movement. A series of multiple aluminum extrusions may be assembled to make unlimited lengths.

The aluminum extrusions may be assembled into a 3-dimensional framework using the vertical extrusions and the horizontal extrusions to form a structural design for creating complete enclosures. Rigid or flexible panels may create rooms or shelving fixtures. In some embodiments, the extrusions may be hung from the ceiling by attachment using wire or rope inserted into a custom hanging connector.

In an exemplary embodiment, the invention may be used in the following manner, by a process or method comprising one or more of the following steps and combinations thereof. A system as described hereinabove is provided. A base may be attached to a horizontal or vertical surface using mechanical fasteners and/or adhesives. The vertical aluminum extrusion may be inserted into the base and may lock into place using preinstalled spring pins that align with a corresponding hole in the base, preventing the vertical aluminum extrusion from being removed unless both spring pins are pressed in to disengage from the holes in the base. Once secured in place, the flexible or rigid panels may be advanced for mounting into the top of the vertical extrusion due to the fact that the circular internal channels may accept the slightly smaller diameter tubular ends of the panels. Once inserted, the panels may not be pulled through the smaller opening of the internal channel which faces the panel. The panels may then be locked into place vertically either using a decorative cap (not shown) or if being used in a freestanding application, a horizontally fixed vertical aluminum extrusion using a connector.

The system of the present invention may support a wide range of substrates in a secure and decorative manner. The system allows for easy adjustability and simple construction. It also supports very large substrates using a unique interlock system. The system includes sliding interlocking inserts which may require one small hex wrench for all assembly and adjustment. The internal channels of the extrusion allow any substrate to be used up to 6 mm (¼") thick including fabric.

Because of the unique shape of the internal channel and the ability of the poles to slide into position, by using a specific vinyl keder welded to a fabric substrate and inserted into the smaller opening of the side or top channel, a fabric display that uses torsion to hold the fabric in place and adjust the tension makes it a unique design that will compete with an industry established system of sewing a flat keder and pushing it into a defined shape that usually cannot be adjusted for tightness.

In some embodiments, a typical use application may be for creating barriers in public spaces to reduce the risk of social interaction.

In some embodiments, the system may be designed to construct these barriers in an attractive and easy to install manner that is structurally sound.

In some embodiments, the use of vertical extrusions with flexible mounting options may lend itself to creating barriers between individuals and between groups of people as would occur in places such as, for example without limitation, restaurants, airports, stadiums, office complexes and the like.

The system of the present invention may provide an attractive, structural system for supporting both flexible and rigid substrates.

The system may comprise at least one aluminum extrusion with an internal slot. The internal slot has a cross section that comprises a round innermost portion and a square outermost portion. The system may further comprise a fitting. The fitting is capable of sliding into an end of the extrusion for the purpose of joining a first extrusion to a second extrusion. In one embodiment the fitting may be an L-shaped adapter capable of use to join two extrusions in a 90 degree fashion. In some embodiments the fitting may permit an extrusion to be attached to another surface. Adding more extrusions and affixing fittings may allow a wide range of designs to be created with a minimal number of different pieces.

An extrusion may be combined with other extrusions to create a complete frame structure for holding a wide range of substrates either internally within the channels or externally with a swivel connector capable of holding a substrate flush with an outside edge of the frame structure.

Each extrusion may be inserted into a base constructed and arranged to hold an extrusion in a vertical orientation. A horizontal extrusion may be attached to a vertical extrusion with an L-shaped metal connector that slides into the internal channel of the extrusion, and may then be locked in place with one or more set screws. The L-shaped connector may be used with a 2-way or 3-4 way adapter made out of the same extrusion and cut to provide a finished looking connection and add stability. The only tool required for assembly is a 2 mm hex wrench capable of use to tightens a screw that is hidden within the connectors and creates force to wedge the round portion tightly to the inside of the square channel.

In one application, a flexible substrate that has a keder strip attached to at least one side that has a round portion that fits into the square portion of the internal channel or a rigid panel that is no more than 6 mm thick that inserts into the square/round slot or if thicker can be attached to the outside edge of the extrusion using a swivel connector and fasteners.

In another application, flexible materials such as fabric and PVC sheeting can have specially made vinyl keder sewn or welded to their opposing edges that allows the edges to be inserted into the square portion of the channel and then pulled tight by sliding the extrusions away from each other vertically to create torque (Torque Loc™), causing the rounded portion to become fixed within the channel.

In another application, rigid panels of 6 mm thickness or less can be inserted into the internal channels directly and held in place on three or four sides within the extrusions channels and held together with the L connectors and adapters.

In another application, rigid panels of any thickness can be attached to the outside edge of the extrusions using swivel connectors and fasteners or adhesives.

In another application, rigid or flexible panels can have special rounded keder attached to the top edge that allows the panel to be inserted into the edge of the extrusions round internal channel but not be able to pull through the smaller square portion of the channel. This allows the panels to be hung vertically or affixed horizontally in a semi-rigid fashion, providing for flexible positioning or straight hanging panels.

In one embodiment the present invention may provide a system for segmenting spaces which comprises a plurality of connector elements, a plurality of aluminum extrusions, and at least one substrate constructed and arranged for securement between the first vertical extrusion and the second extrusion. The plurality of aluminum extrusions may include a first vertical aluminum extrusion, a second vertical aluminum extrusion and at least one horizontal aluminum extrusion. The horizontal aluminum extrusion may have a first horizontal extrusion end and a second horizontal extrusion end. The horizontal extrusion is constructed and arranged for securement of the first horizontal extrusion end to the first vertical aluminum extrusion by a connector element, and securement of the second horizontal extrusion end to the second vertical aluminum extrusion by a connector element. Each extrusion comprises a plurality of interior extrusion channels, each interior extrusion channel further comprising a rounded innermost channel portion having a circular cross section, and a square outer channel portion having a square cross section. Each connector includes a first connector portion and a second connector portion, the first connector portion and second connector portion being shaped to mate with one of said plurality of interior extrusion channels. Each substrate has a first substrate end, a second substrate end and an intermediate substrate portion. Each substrate further comprises a first lateral keder located at the first substrate end and a second lateral keder located at the second substrate end, the first lateral keder and second lateral keder being constructed and arranged to slide into an interior extrusion channel for retention therein.

In some embodiments, the first lateral keder further comprises a first lateral Torque Loc™ element and the second lateral keder further comprises a second lateral Torque Loc™ element, each said Torque Loc™ element being constructed and arranged to securely fit in an interior extrusion channel to securely retain the substrate in place between the first vertical extrusion and the second vertical extrusion.

In some embodiments, connector elements are L-connectors. Each L-connector has a first connector portion and a second connector portion located at a 90 degree angle with respect to each other, each L-connector being constructed and arranged to join the first vertical aluminum extrusion and the second vertical aluminum extrusion to the at least one horizontal aluminum extrusion extending therebetween.

In some embodiments, due to the unique structural properties of the extrusion and fastening system of the present invention, the system may be used in an additional manner to display graphics, in shelving systems, as temporary rooms or as internal structures. In other embodiments, the system of the present invention may lend itself to operating as a support for bracing or holding equipment.

In summary, in an exemplary embodiment, the present invention may provide an aluminum extrusion system for supporting rigid and flexible panels. In one embodiment the inventive aluminum extrusion system may comprise a custom designed aluminum extrusion that may mount flexible or rigid substrates with interlocking bases and connectors and is structurally sound, and safe. In addition, the aluminum extrusion system effectively blends with the existing décor. The aluminum extrusion system provides a method for segmenting space to maximize the functional space which may be utilized, in a way that is attractive, functional, temporary or permanent, and portable.

For clarity, only those aspects of the system germane to the invention are described, and product details well known in the art are omitted. In addition, many embodiments of the present invention have application to a wide range of industries. To the extent the present application discloses a system, the method implemented by that system is within the scope of the present invention. Further, to the extent the present application discloses a method, a system of apparatuses configured to implement the method are within the scope of the present invention.

It should be understood, of course, that the foregoing relates to exemplary embodiments of the invention and that modifications, variations and changes in detail may be made without departing from the spirit and scope of the invention as set forth in the following claims.

What is claimed is:

1. A system for segmenting spaces, the system comprising:

a plurality of connector elements;

a plurality of aluminum extrusions, said plurality of aluminum extrusions comprising:

a first vertical aluminum extrusion;

a second vertical aluminum extrusion; and at least one horizontal aluminum extrusion having a first horizontal extrusion end and a second horizontal extrusion end, the at least one horizontal extrusion being constructed and arranged for securement of the first horizontal extrusion end to the first vertical aluminum extrusion by a connector element of the plurality of connector elements, and securement of the second horizontal extrusion end to the second vertical aluminum extrusion by a connector element of the plurality of connector elements; and at least one substrate, constructed and arranged for securement between the first vertical extrusion and the second vertical extrusion;

wherein each of the first and second vertical aluminum extrusions and the at least one horizontal aluminum extrusion comprises a plurality of interior extrusion channels, each interior extrusion channel further comprising a rounded innermost channel portion having a circular cross section, and a square outer channel portion having a square cross section;

wherein each of the plurality of connector elements includes a first connector portion and a second connector portion, the first connector portion and the second connector portion being shaped to mate with one of said plurality of interior extrusion channels; and wherein each said at least one substrate has a first substrate end, a second substrate end and an intermediate substrate portion, and further comprises a first lateral keder located at the first substrate end and a second lateral keder located at the second substrate end, the first lateral keder and the second lateral keder being constructed and arranged to slide into one of the plurality of an interior extrusion channels for retention therein.

2. The system of claim 1 wherein said at least one substrate is selected from rigid substrates and flexible substrates, and the intermediate substrate portion comprises a material selected from rigid materials and flexible materials.

3. The system of claim 2 wherein the first lateral keder further comprises a first lateral Torque Loc™ element and the second lateral keder further comprises a second lateral Torque Loc™ element, each said first and second lateral Torque Loc™ element being constructed and arranged to securely fit in one of the plurality of interior extrusion channels to securely retain the at least one substrate in place between the first vertical extrusion and the second vertical extrusion.

4. The system of claim 2 wherein said at least one substrate further comprises a flexible transparent panel.

5. The system of claim 1 further comprising a plurality of metal bases, said plurality of metal bases further comprising a first metal base constructed and arranged for supporting the first vertical aluminum extrusion, and a second metal base constructed and arranged for supporting the second vertical aluminum extrusion.

6. The system of claim 5 wherein the first vertical aluminum extrusion and the second vertical aluminum extrusion each further comprise an internal channel and a spring button constructed and arranged to lock into the first metal base and the second metal base, respectively.

7. The system of claim 6 wherein each said plurality of metal bases further comprises a base locking hole and a base keyway.

8. The system of claim 7 wherein the plurality of connector elements further comprises a plurality of L-connectors, each L-connector having a first connector portion and a second connector portion located at a 90 degree angle with respect to each other, each L-connector being constructed and arranged to join the first vertical aluminum extrusion and the second vertical aluminum extrusion to the at least one horizontal aluminum extrusion extending therebetween.

9. The system of claim 8 further comprising at least one 3-4 way spacer located between the first vertical aluminum extrusion and the first horizontal aluminum extrusion end, and at least one 1-2 way spacer located between the second vertical aluminum extrusion and the second horizontal aluminum extrusion end.

10. The system of claim 9 further comprising a wall connector assembly.

* * * * *